US008646242B2

(12) United States Patent
Shapiro et al.

(10) Patent No.: US 8,646,242 B2
(45) Date of Patent: Feb. 11, 2014

(54) MODULAR FLOOR TILE WITH CONNECTOR SYSTEM

(75) Inventors: Jeremiah D. Shapiro, Herriman, UT (US); Jorgen J. Moller, Jr., Salt Lake City, UT (US); Lance C. Rushton, Riverton, UT (US)

(73) Assignee: Snap Lock Industries, Inc., Salt Lake City, UT (US)

( * ) Notice: Subject to any disclaimer, the term of this patent is extended or adjusted under 35 U.S.C. 154(b) by 439 days.

(21) Appl. No.: 12/562,824

(22) Filed: Sep. 18, 2009

(65) Prior Publication Data

US 2011/0067340 A1 Mar. 24, 2011

(51) Int. Cl.
*E04G 21/00* (2006.01)

(52) U.S. Cl.
USPC ..... 52/747.11; 52/741.1; 52/506.1; 52/588.1; 52/581

(58) Field of Classification Search
USPC ..... 52/506.01, 581, 588.1, 578, 747.11, 52/741.1, 589.1, 592.1, 284, 285.1, 69; 403/56, 122; 404/41; 446/124, 125
See application file for complete search history.

(56) References Cited

U.S. PATENT DOCUMENTS

| | | | | |
|---|---|---|---|---|
| 738,704 | A | 9/1903 | Semmer | |
| 1,420,775 | A | 6/1922 | Stanwood | |
| 1,625,187 | A | 4/1927 | Birch | |
| D93,991 | S | 12/1934 | Moore | |
| 2,780,150 | A * | 2/1957 | Yeoman | 264/261 |
| 3,015,136 | A | 1/1962 | Doe | |
| 3,093,870 | A | 6/1963 | Brock | |
| 3,196,763 | A | 7/1965 | Rushton | |
| 3,279,138 | A | 10/1966 | Dittmar | |
| 3,284,819 | A | 11/1966 | Nissen | |
| 3,289,375 | A | 12/1966 | Cline | |
| 3,319,392 | A | 5/1967 | Fitzgerald | |
| 3,452,497 | A | 7/1969 | Warp | |
| 3,500,606 | A * | 3/1970 | Wharmby | 52/591.1 |
| 3,717,247 | A | 2/1973 | Moore | |
| 3,722,704 | A * | 3/1973 | Piretti | 211/183 |
| 3,731,445 | A * | 5/1973 | Hoffmann et al. | 52/391 |
| 3,741,411 | A | 6/1973 | Peacock | |
| 3,861,592 | A | 1/1975 | Fisher | |
| 3,909,996 | A | 10/1975 | Ettlinger, Jr. et al. | |

(Continued)

FOREIGN PATENT DOCUMENTS

GB 2262437 6/1993

OTHER PUBLICATIONS

Athletic Business, advertisement for Flexideck, p. 81; advertisement for Sport Floor, p. 53; advertisement for Basic Coatings Sports, p. 43, Mar. 2001.

*Primary Examiner* — Robert Canfield
*Assistant Examiner* — Matthew Gitlin
(74) *Attorney, Agent, or Firm* — Holland & Hart

(57) ABSTRACT

Modular floor tiles and modular floors are described herein. A modular floor tile may include a top surface, a plurality of edge surfaces, and a plurality of interlocking member for attachment to adjacent tiles. One interlocking member may include a protrusion having a curved interlocking portion. Another interlocking member may include a recess having a curved pocket portion. An interface between the curved interlocking portion of one tile and the curved pocket portion of another tile may allow pivot movement between the tiles. A modular floor may include a plurality of interlocking tiles connected to one another. Methods of forming a modular floor that includes a plurality of modular floor tiles are also disclosed.

19 Claims, 10 Drawing Sheets

(56) References Cited

U.S. PATENT DOCUMENTS

| | | | | | |
|---|---|---|---|---|---|
| 4,008,548 | A | | 2/1977 | Leclerc | |
| 4,051,987 | A | | 10/1977 | Scribner | |
| 4,099,887 | A | * | 7/1978 | Mackenroth | 403/4 |
| 4,109,821 | A | * | 8/1978 | Lutz | 220/836 |
| 4,253,268 | A | * | 3/1981 | Mayr | 446/104 |
| 4,695,502 | A | * | 9/1987 | Rush | 428/192 |
| 4,761,315 | A | * | 8/1988 | Logan et al. | 428/33 |
| 4,792,319 | A | * | 12/1988 | Svagerko | 446/104 |
| 4,807,412 | A | * | 2/1989 | Frederiksen | 52/177 |
| 4,930,286 | A | | 6/1990 | Kotler | |
| 5,180,250 | A | * | 1/1993 | Ferro | 403/252 |
| 5,348,778 | A | * | 9/1994 | Knipp et al. | 428/35.8 |
| 5,406,745 | A | * | 4/1995 | Lin | 47/1.01 F |
| 5,570,971 | A | * | 11/1996 | Rixen et al. | 403/381 |
| 6,006,486 | A | * | 12/1999 | Moriau et al. | 52/589.1 |
| 6,089,784 | A | * | 7/2000 | Ardern | 404/41 |
| 6,098,365 | A | * | 8/2000 | Martin et al. | 52/592.1 |
| 6,751,912 | B2 | | 6/2004 | Stegner et al. | |
| 6,804,926 | B1 | * | 10/2004 | Eisermann | 52/592.1 |
| 7,065,935 | B2 | * | 6/2006 | Ralf | 52/747.1 |
| 7,066,778 | B2 | * | 6/2006 | Kretzschmar | 446/92 |
| 7,114,298 | B2 | | 10/2006 | Kotler | |
| 7,299,592 | B2 | | 11/2007 | Moller, Jr. | |
| 7,354,330 | B2 | * | 4/2008 | Bentley, Jr. | 446/102 |
| 7,451,578 | B2 | * | 11/2008 | Hannig | 52/586.1 |
| 7,571,572 | B2 | | 8/2009 | Moller, Jr. | |
| 7,748,177 | B2 | * | 7/2010 | Jenkins et al. | 52/177 |
| 7,856,789 | B2 | * | 12/2010 | Eisermann | 52/747.1 |
| 7,896,571 | B1 | * | 3/2011 | Hannig et al. | 403/339 |
| 2003/0208979 | A1 | * | 11/2003 | Sorensen et al. | 52/591.1 |
| 2005/0005559 | A1 | * | 1/2005 | Ralf | 52/589.1 |
| 2005/0193669 | A1 | | 9/2005 | Jenkins et al. | |
| 2006/0070314 | A1 | | 4/2006 | Jenkins et al. | |
| 2007/0221594 | A1 | * | 9/2007 | Pierro | 211/94.01 |
| 2009/0031658 | A1 | | 2/2009 | Moller, Jr. et al. | |

* cited by examiner

MODULAR FLOOR TILE WITH CONNECTOR SYSTEM

TECHNICAL FIELD

This relates generally to floor tiles, and more particularly to connectors for modular floor tiles.

BACKGROUND

Floor tiles have traditionally been used for many different purposes, including both aesthetic and utilitarian purposes. For example, floor tiles of a particular color may be used to accentuate an object displayed on top of the tiles. Alternatively, floor tiles may be used simply to protect the surface beneath the tiles from various forms of damage. Floor tiles typically comprise individual panels that are placed on the ground either permanently or temporarily depending on the application. A permanent application may involve adhering the tiles to the floor in some way, whereas a temporary application would simply involve setting the tiles on the floor. Some floor tiles may be interconnected to one another to cover large floor areas such as a garage, an office, or a show floor. Other interconnected tile systems are used as dance floors and sports court surfaces.

Many different types of connectors have been used to interconnect adjacent floor tiles. Some types of connectors provide connection and disconnection of the floor tiles, while other types of connectors provide permanent connection of the floor tiles. The type of connectors used to interconnect floor tiles can influence properties of the individual floor tiles and the resulting floor surface defined by a plurality of interconnected floor tiles. Opportunities exist for improving connectors used to interconnect floor tiles.

SUMMARY

One aspect of the present disclosure relates to a modular floor tile that includes a top surface, a plurality of edge surfaces, at least one interlocking protrusion, and at least one interlocking recess. The at least one interlocking protrusion extends from at least one of the plurality of edge surfaces. The at least one interlocking member includes a curved interlocking portion. The at least one interlocking recess includes a curved pocket portion and is configured to receive the curved interlocking portion of the protrusion. An interface between the curved pocket portion and the curved interlocking portion allowing adjacent tiles to pivot relative to each other.

The at least one interlocking recess may be positioned adjacent to at least one of the edge surfaces and is open along the top surface. The at least one interlocking protrusion may be arranged to interlock with an interlocking recess of an adjacent modular floor tile. The curved pocket portion of the at least one interlocking recess may include a spherical shape. The at least one interlocking recess may be defined inward of the plurality of edge surfaces. The curved interlocking portion of the at least one interlocking protrusion may include a spherical shape.

Another aspect of the present disclosure relates to a portion of a modular floor that includes first and second tiles. The first tile includes a top surface, a plurality of edge surfaces, and at least one protrusion. The at least one protrusion extends from at least one of the plurality of edge surfaces and includes a curved interlocking portion. The second tile includes a top surface, a plurality of edge surfaces, and at least one recess. The at least one recess includes a curved pocket portion that is configured to receive the curved interlocking portion of one of the protrusions of the first tile to interlock the first and second tiles. An interface between the curved pocket portion and the curved interlocking portion permits the first and second tiles to pivot relative to each other.

The at least one recess may be open along the top surface of the second tile. The curved pocket portion of the at least one recess may include a spherical shape, and the curved interlocking portion of the at least one protrusion may include a spherical shape. The first tile may include at least one protrusion extending from two of the plurality of edge surfaces of the first tile, and at least one recess positioned along two of the plurality of edge surfaces of the first tile. Each of the recesses of the first tile being may be configured to receive a protrusion of an adjacent tile of the modular floor. The second tile may include at least one protrusion extending from two of the plurality of edge surfaces of the second tile, and at least one recess positioned along two of the plurality of edge surfaces of the second tile. Each of the recesses of the second tile being may be configured to receive a protrusion of an adjacent tile of the modular floor.

Another aspect of the present disclosure relates to a method of forming a modular floor. The method includes providing a first interlocking tile comprising at least one interlocking protrusion having a curved interlocking portion, providing a second interlocking modular tile comprising at least one interlocking recess having a curved pocket portion, and inserting the interlocking portion of the at least one interlocking protrusion of the first interlocking tile into the curved pocket portion of the at least one interlocking recess of the second interlocking tile to connect the first interlocking tile to the second interlocking tile. An interface between the curved pocket portion and the curved interlocking portion may allow the first and second interlocking tiles to pivot relative to each other.

The first interlocking tile may include a top surface and a plurality of edge surfaces, the at least one interlocking protrusion may extend from one of the plurality of edge surfaces, and the second interlocking tile may include a top surface and a plurality of side surfaces. The at least one interlocking recess may be accessible at the top surface of the second interlocking tile, and inserting the at least one interlocking protrusion may include inserting the at least one interlocking protrusion into the at least one recess at the top surface. An edge portion of the at least one recess may be defined in one of the plurality of edge surfaces of the second tile, and inserting the interlocking protrusion into the at least one recess includes positioning a portion of the at least one interlocking protrusion into the edge portion of the at least one recess. The method may also include positioning the first and second tiles adjacent to each other with an edge surface of the first tile facing an edge surface of the second tile. Prior to inserting the at least one interlocking protrusion in the at least one recess, the method may include positioning at least a portion of the at least one interlocking protrusion at a position elevated above the at least one recess.

A further aspect of the present disclosure relates to a method of connecting a plurality of modular floor tiles. The method includes providing a first modular floor tile that includes at least a first interlocking member, providing a second modular floor tile that includes at least a second interlocking member, contacting the first and second interlocking members of the first and second modular floor tiles in a first rotated position relative to each other, and pivoting the first and second modular floor tiles into a second rotated position relative to each other.

The first interlocking member may include a protrusion having curved interlocking portion, and the second interlocking member includes a recess having an open top portion and a curved pocket portion, and contacting the first and second interlocking members includes inserting the curved interlocking portion of the protrusion through the open top portion of the recess and contacting the curved interlocking portion with the curved pocket portion. An interface between the curved interlocking portion and the curved pocket portion may allow the first and second modular floor tiles to pivot relative to each other. The curved interlocking portion may include a spherical shaped portion and the curved pocket portion may include a spherical shaped portion. Pivoting the first and second modular floor tiles may include pivoting the first and second modular floor tiles relative to each other about an interface between the spherical shaped portions of the first and second interlocking members.

The foregoing features and advantages, together with other features and advantages, will become more apparent when referring to the following specification, claims and accompanying drawings.

BRIEF DESCRIPTION OF THE DRAWINGS

The accompanying drawings illustrate various embodiments and are a part of the specification. The illustrated embodiments are merely examples and do not limit the claims.

Throughout the drawings, identical reference numbers designate similar, but not necessarily identical, elements.

DETAILED DESCRIPTION

Figure 1:
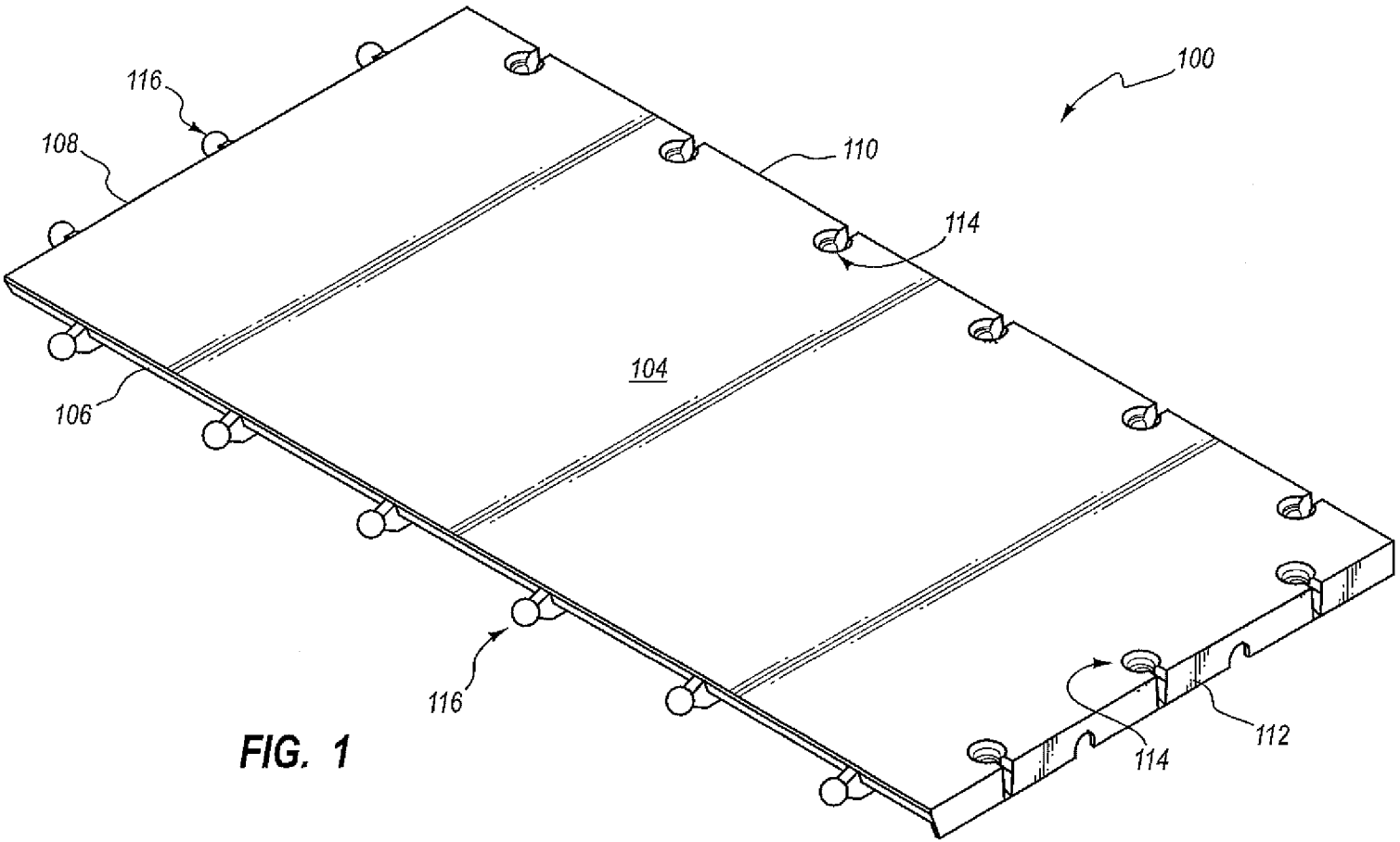
FIG. 1 is a top perspective view of an example modular floor tile in accordance with the present disclosure.

As mentioned above, typical modular flooring is interconnected with a plurality of connectors. One aspect of the present disclosure relates to connector features that include curved or contoured portions such as spherical or partial spherical structures. In one example, the connector feature is a recess having a curved portion that mates with a curved portion of a connector protrusion feature. The application of the principles described herein is not limited to the specific embodiments shown. Some alternative embodiments may include connector recesses and mating protrusions that include shapes that are not solely curved or contoured. For example, the connector recesses and mating protrusions may include concave and convex shapes that include planar portions, and other non-circular cross-sectional shapes.

The principles described herein may be used with any flooring system. Moreover, although certain embodiments shown incorporate multiple novel features, the features may be independent and need not all be used together in a single embodiment. Tiles and flooring systems according to principles described herein may comprise any number of the features presented. Therefore, while the description below is directed primarily to interlocking plastic modular floors, the methods and apparatus are only limited by the appended claims.

As used throughout the claims and specification, the term "modular" refers to objects of regular or standardized units or dimensions, as to provide multiple components for assembly of flexible arrangements and uses. A "top" surface of a modular tile refers to the upper exposed surface when the tile is placed on a support, or the designated surface for stepping on, driving on, supporting objects, etc. A "sphere" or "spherical" shape is typically a structure that is bounded by a surface consisting of all points at a given distance from its center. A structure that is spherical or has a spherical portion may include all or a part of a spherical shape. A structure having a "curved shape" or a "curved portion" may include some curvature, contour, or curvilinear portion across a surface of the structure. The words "including" and "having," as used in the specification, including the claims, have the same meaning as the word "comprising."

Referring now to the drawings, FIGS. 1-8 illustrate an example modular floor tile 100. The modular floor tile 100 of FIGS. 1-8 may comprise injection molded plastic. The modular floor tile 100 and other similar or identical modular floor tiles may be interlocked according to principles disclosed herein to form a modular floor, such as a sports court floor, as discussed below with reference to FIGS. 9-17. Aspects of the modular floor tile 100 may facilitate increased ease in assembling a modular floor and may result in reduced time requirements for assembling the modular floor. Aspects of the modular tile 100 may also facilitate improved ease in disassembling a modular floor that has been previously assembled. Other aspects of the modular tile 100 may provide for some relative movement such as pivotal movement or hinged movement between adjacent modular floor tiles of the modular floor that are connected together.

The modular floor tile 100 may include a plurality of interlocking features for attachment to adjacent tiles. Multiple modular floor tiles 100 may be interlocked to create a floor of any size and shape. The modular floor tile 100 shown in FIGS. 1-8 has a generally rectangular shape with a greater length dimension than a width dimension. Other shapes are possible for the modular floor tile 100 including, for example, square, triangular, hexagonal, and other shapes. Further, modular floor tiles having different sizes but the same rectangular shape may be used to create a modular floor by interlocking the modular floor tiles of different sizes.

Figure 2:
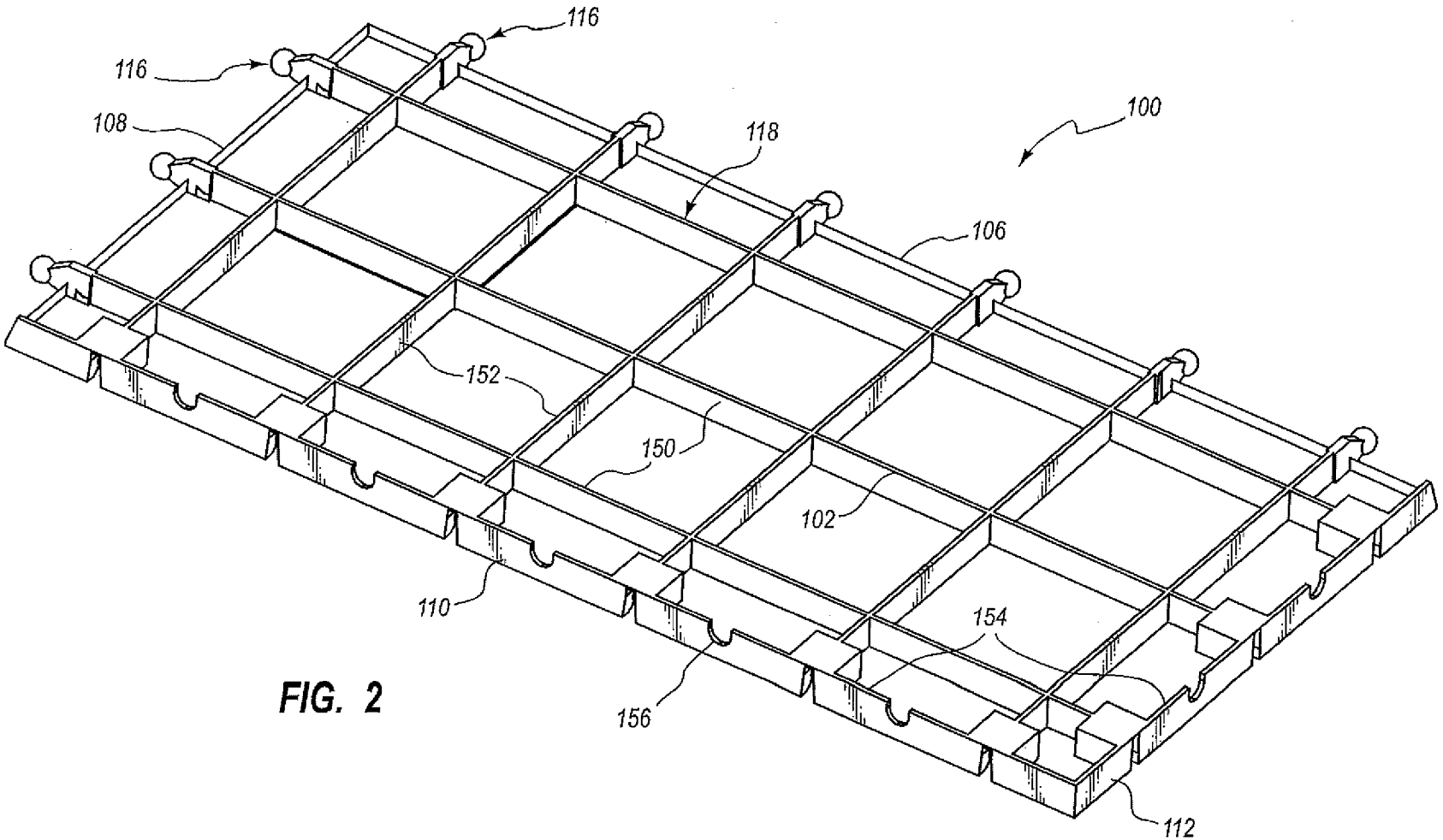
FIG. 2 is a bottom perspective view of the modular floor tile of FIG. 1.
Figures 3, 5:
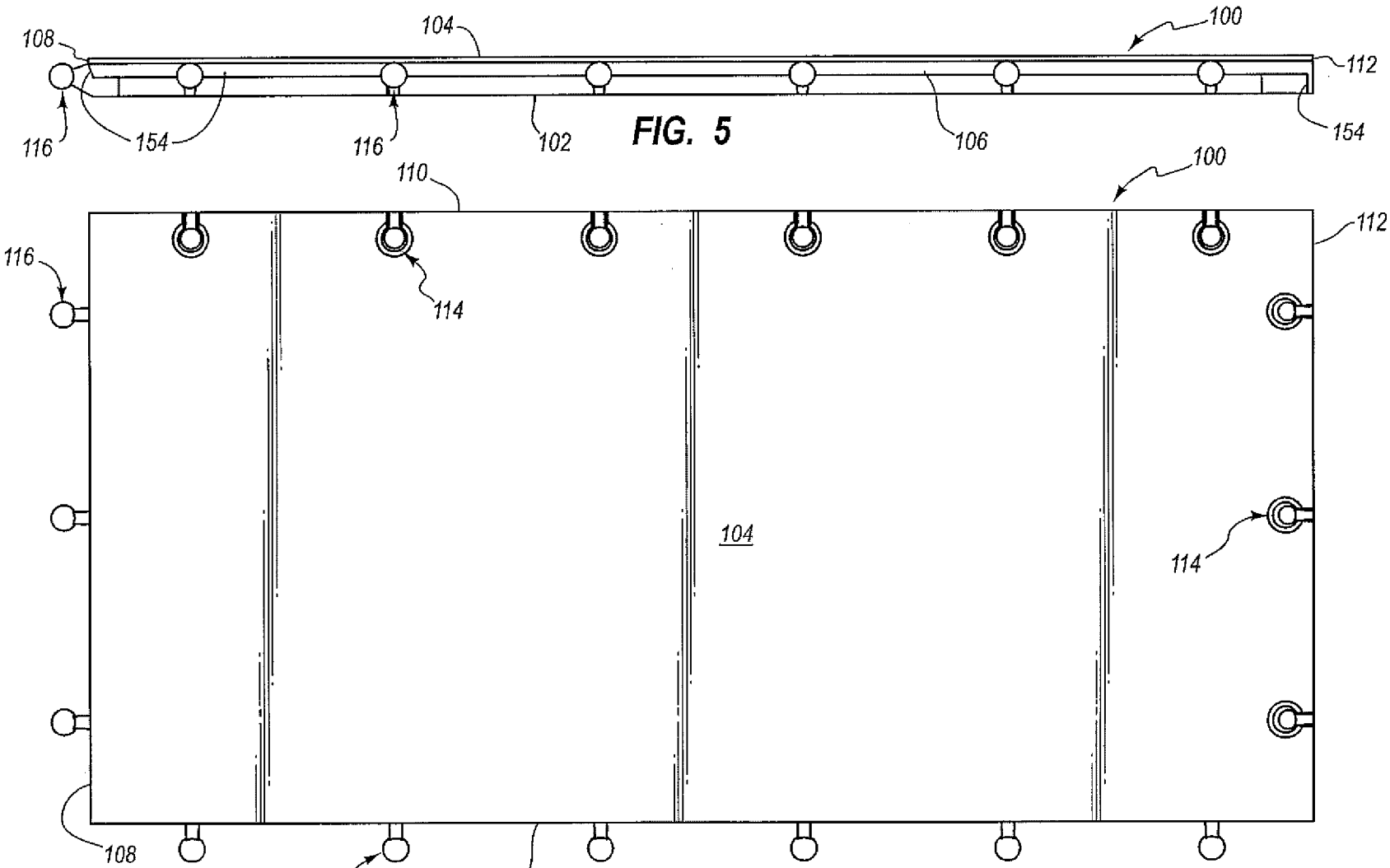
FIG. 3 is a top view of the modular floor tile of FIG. 1.
FIG. 5 is a front view of the modular floor tile of FIG. 1.
Figure 6:
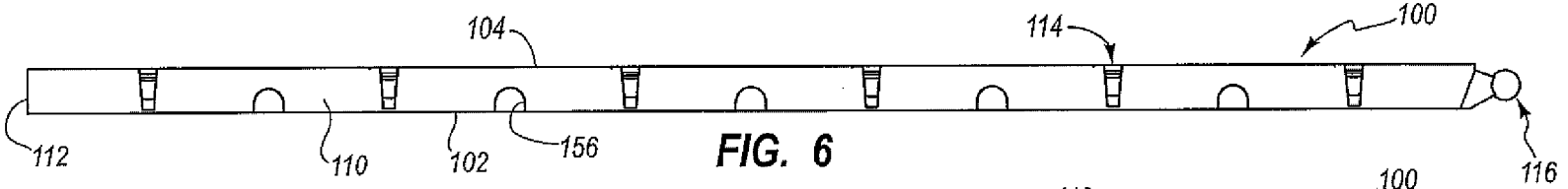
FIG. 6 is a rear view of the modular floor tile of FIG. 1.

Modular floor tile 100 includes a bottom surface 102, a top surface 104, and a plurality of side edge surfaces 106, 108, 110, 112. The side edge surfaces 106, 108, 110, 112 may extend from the bottom surface 102 to the top surface 104. In some arrangements, the side edge surfaces 106, 108, 110, 112 may extend only partially between the bottom and top surfaces 102, 104. For example, the sides 106, 108 shown in FIGS. 1 and 5 extend only partially from the top surface 104 towards the bottom surface 102. Referring to FIGS. 2 and 6, the side edge surfaces 110, 112 extend the entire distance from the top surface 104 to the bottom surface 102.

The modular floor tile 100 may also include a plurality of interlocking recesses 114. Interlocking recesses 114 may be positioned along one or more of the side edge surfaces 106, 108, 110, 112. In at least one example, at least one interlocking recess 114 is positioned along each of the side edge surfaces 110, 112. In at least some arrangements, at least portions of the interlocking recesses 114 are accessible through the top surface 104. In some arrangements, the interlocking recesses 114 may be accessible along one of the side edge surfaces such as the side edge surfaces 110, 112. In still further arrangements, at least portions of the interlocking recess 114 may be accessible from at least the top surface 104 and at least one of the side edge surfaces 110, 112. Further details related to the interlocking recesses 114 are described below with reference to FIGS. 14 and 17.

The modular floor tile 100 may also include a plurality of interlocking protrusions 116. The interlocking protrusions 116 may be positioned along at least one of the side edge surfaces 106, 108, 110, 112. In some arrangements, two or more interlocking protrusions 116 are positioned along at least one of the side edge surfaces 106, 108, 110, 112. FIGS. 1-8 illustrate a plurality of interlocking protrusions 116 positioned along two of the side edge surfaces 106, 108. In some examples, at least one interlocking protrusion 116 may be positioned along more than two of the side edge surfaces 106, 108, 110, 112.

Figure 4:
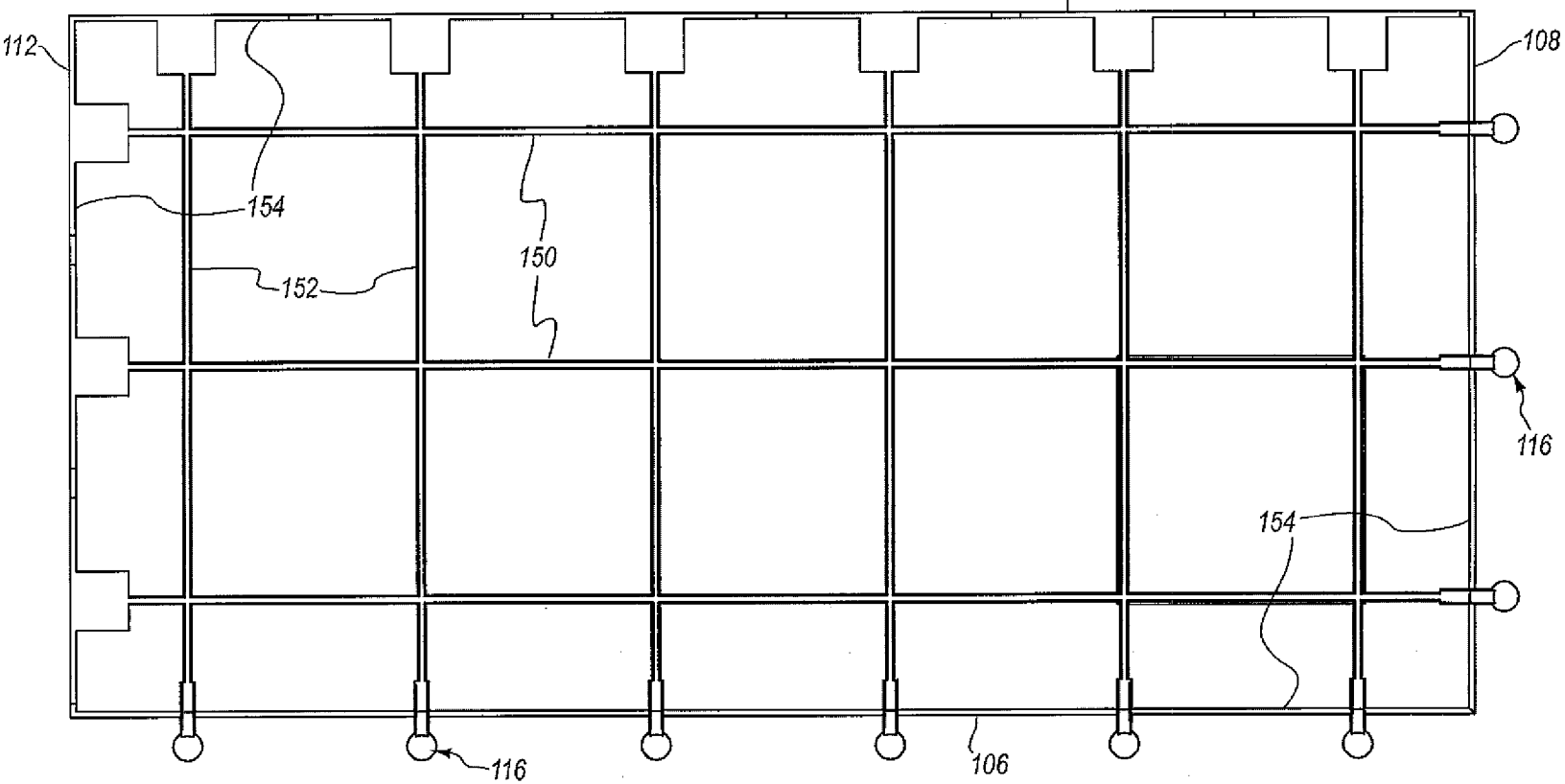
FIG. 4 is a bottom view of the modular floor tile of FIG. 1.
Figure 7:
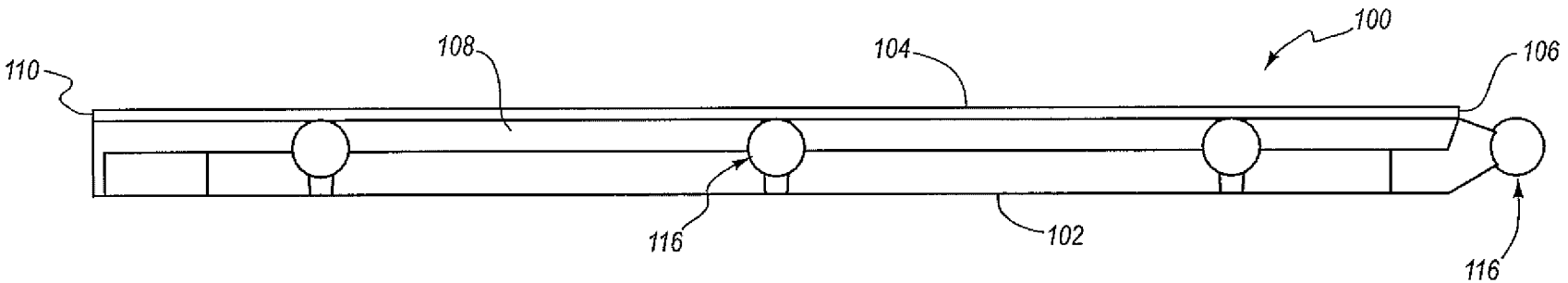
FIG. 7 is a first side view of the modular floor tile of FIG. 1.
Figure 8:
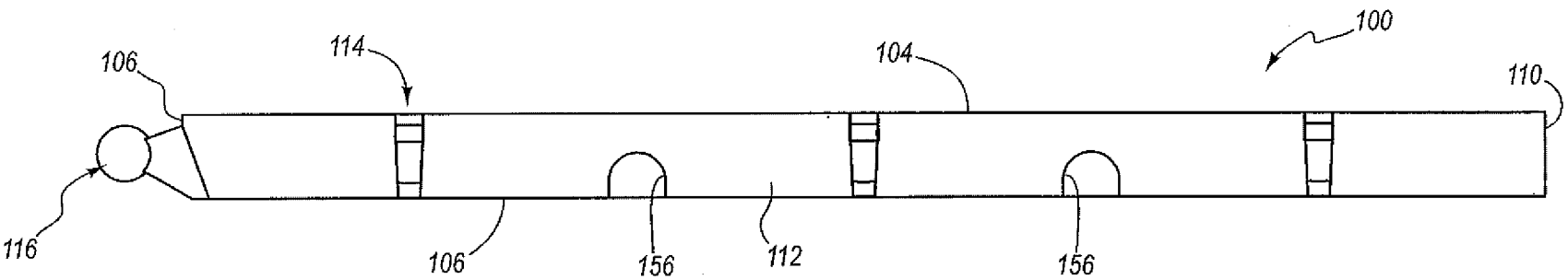
FIG. 8 is an opposite side view of the modular floor tile of FIG. 1.
Figure 9:
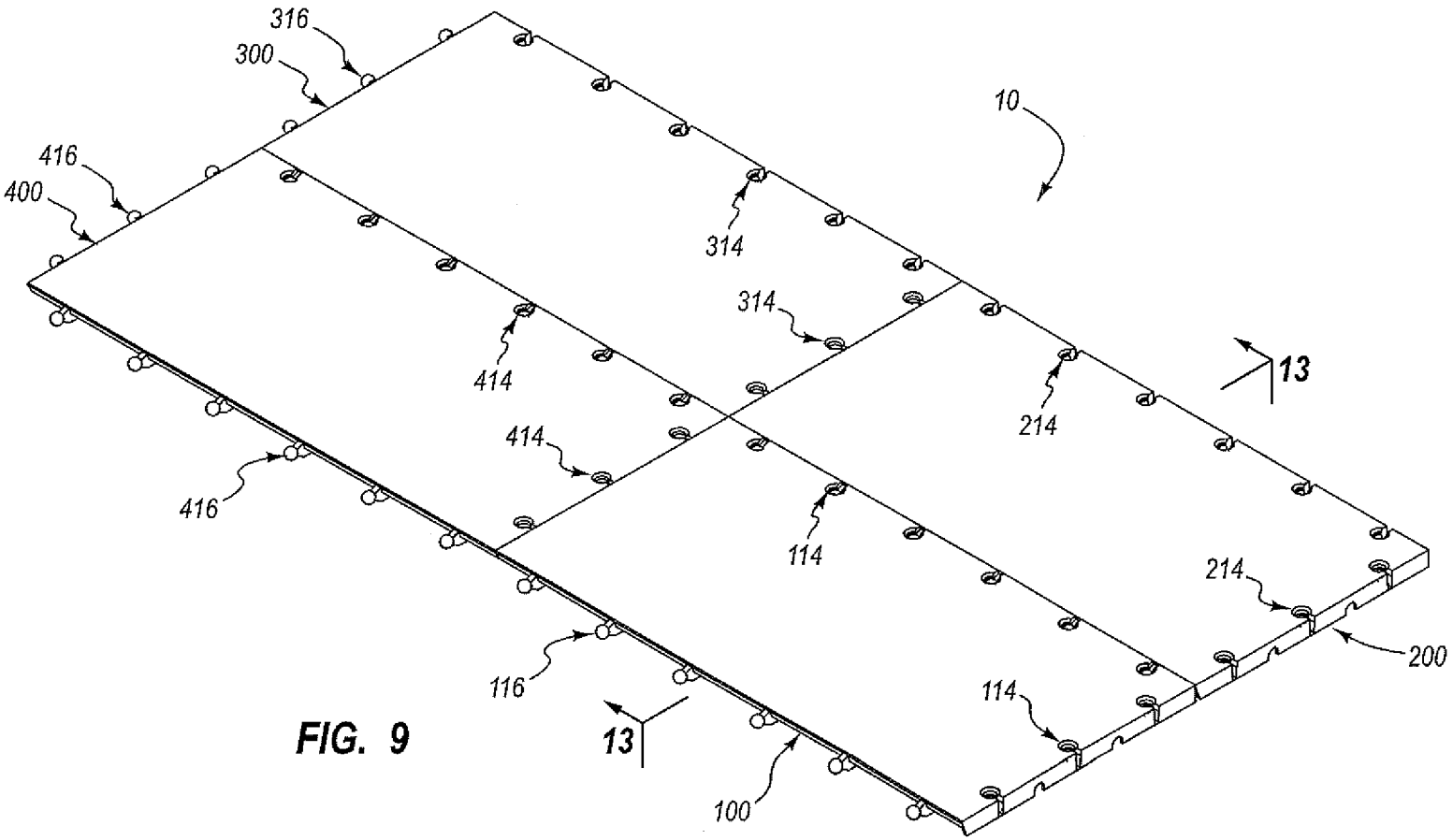
FIG. 9 is a top perspective view of an example modular floor assembly that includes the modular floor tile of FIG. 1 assembled with three other additional modular floor tiles.
Figure 10:
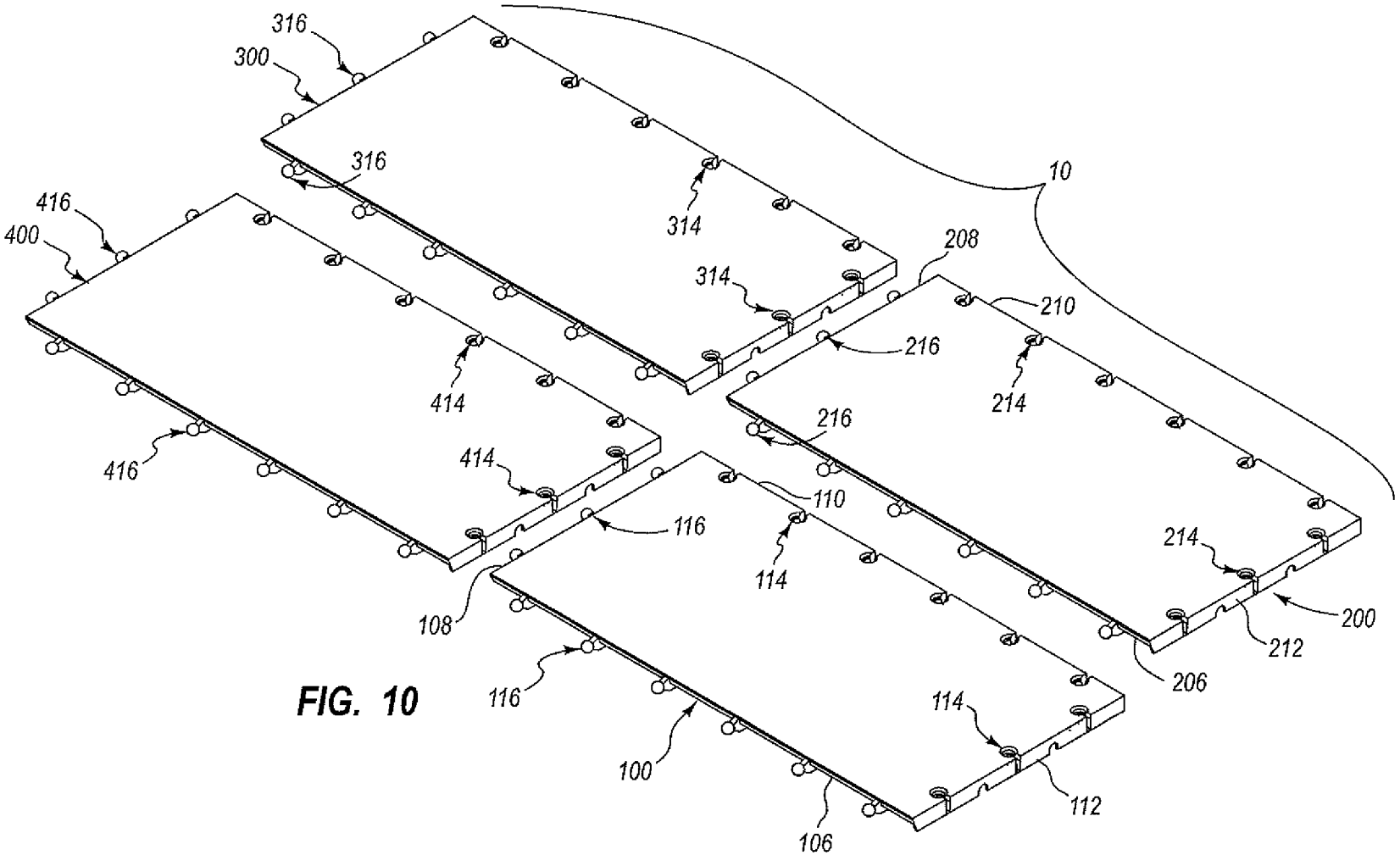
FIG. 10 is an exploded top perspective view of the modular floor tile assembly of FIG. 9.

The interlocking protrusions 116 extend laterally out from at least one of the side edges of the modular floor tile 100. Referring to FIGS. 4 and 5, the interlocking protrusions 116 are shown extending outward from the side edge 108 in a lateral direction. The term "lateral" as it related to the modular floor tile 100 may be defined as a direction generally outward from a central portion of the modular floor tile. The term "lateral" may also be defined as extending away from any one of the side edge surfaces 106, 108, 110, 112. The term "lateral" may be defined as a direction generally parallel with one of the bottom and top surfaces 102, 104.

The interlocking protrusions 116 are sized and configured to extend into the interlocking recesses 114 of an adjacent modular floor tile or portion of a modular floor assembly (i.e., an edge piece). Further details related to the interconnection between adjacent modular floor tiles including positioning of the interlocking protrusions 116 of one modular floor tile in the interlocking recesses 114 of an adjacent modular floor tile are described below with reference to FIGS. 9-17.

The modular floor tile 100 may also include a support structure 118 (see FIGS. 3 and 4). The support structure 118 may include a plurality of first supports 150 and a plurality of second supports 152. The first supports 150 extend between the side edge surfaces 108, 112. The second supports 152 extend between the side edge surfaces 106, 110. The first and second supports 150, 152 may terminate at locations spaced inward from the side edge surfaces 106, 108, 110, 112. The first and second supports 150, 152 may intersect each other to create a lattice structure between the bottom and top surfaces 102, 104. The first and second supports 150, 152 may be accessible from the bottom surface 102. The first and second supports 150, 152 may define in part the bottom surface 102 of the modular floor tile 100.

The support structure 118 may also include a peripheral support 154. The peripheral support 154 may be defined in part by the side edge surfaces 106, 108, 110, 112 may define in part the side edge surfaces 106, 108, 110, 112. In at least some arrangements, the first and second supports 150, 152 terminate at or intersect with the peripheral support 154.

The modular floor tile 100 may include a plurality of bottom apertures 156 positioned in the peripheral support 154. The bottom apertures 156 may provide access into the modular floor tile 100 in a lateral direction to provide, for example, a drain area or an area for air flow.

The interlocking recesses 114 may be aligned with one of the first and second supports 150, 152. The interlocking recesses 114 along the side edge 110 being aligned with the second supports 152 (see FIGS. 2 and 4). The interlocking recesses 114 along the side edge 112 may be aligned with the first supports 150. In at least one arrangement, each of the interlocking recesses 114 is aligned with one of the first and second supports 150, 152. At least one of the first and second supports 150, 152 may be arranged to intersect a central portion of the interlocking recess 114. For example, the first and second supports 150, 152 may be aligned with a longitudal axis passing through the interlocking recess 114 from the side edge 112 inward in the tile 100.

The interlocking protrusions 116 may be aligned with at least one of the first and second supports 150, 152. At least FIGS. 2 and 4 illustrate the interlocking protrusions 116 along the side edge 106 aligned with the second supports 152. The interlocking protrusions 116 along the side edge 108 may be aligned with the first supports 150. In at least one arrangement, each of the interlocking protrusions 116 is aligned with at least one of the first and second supports 150, 152. In some arrangements, at least one of the first and second supports 150, 152 is arranged coaxial with a longitudal axis passing through the interlocking protrusions 116.

At least FIGS. 2 and 3 illustrate an interlocking recess 114 positioned at one end of each of the first and second supports 150, 152, and an interlocking protrusion 116 positioned at an opposite end of each of the first and second supports 150, 152. In some arrangements, each of the interlocking recesses 114 is aligned with an interlocking protrusion that is positioned on an opposite side edge of the modular floor tile 100.

The support structure 118 may provide support for the top surface 104 of modular floor tile 100. At least some aspects of the support structure 118 (i.e., the first and second supports 150, 152) may also support the interlocking recess 114 and interlocking protrusion 116. For example, referring to FIG. 2, the first and second supports 150, 152 may help maintain the interlocking protrusion 116 in a generally upright orientation with the interlocking protrusion 116 extending laterally outward from the side edge surfaces 106, 108. The first and second supports 150, 152 may help resist side-to-side and up-and-down movement of the interlocking protrusions 116 relative to the side edge surfaces 106.

Referring now to FIGS. 9-17, an example modular floor assembly 10 is shown and described. The modular floor assembly 10 includes a plurality of modular floor tiles 100, 200, 300, 400. The modular floor tiles 100, 200, 300, 400 may each include a plurality of interlocking recesses 114, 214, 314, 414 and a plurality of interlocking protrusions 116, 216, 316, 416, respectively. The interlocking recesses and interlocking protrusions of the modular floor tiles 100, 200, 300, 400 interlock to provide the modular floor assembly arrangement of FIG. 9. Additional modular floor tiles may be interconnected to any one of the modular floor tiles 100, 200, 300, 400 to expand the size of the modular floor assembly 10. Further, modular floor tile of different sizes and shapes may be interlocked with any one of the modular floor tiles 100, 200, 300, 400 to change a shape and size of the modular floor assembly 10.

The modular floor assembly 10 may be constructed with any number of modular floor tiles to create a modular floor having a specific purpose such as, for example, a basketball court or other sport surface, a garage floor, or a show floor. The modular floor tiles 100, 200, 300, 400 may include graphics such as text, color patterns, and other features on the top surface 104 that enhance the purpose and function of the modular floor assembly 10.

Figure 11:
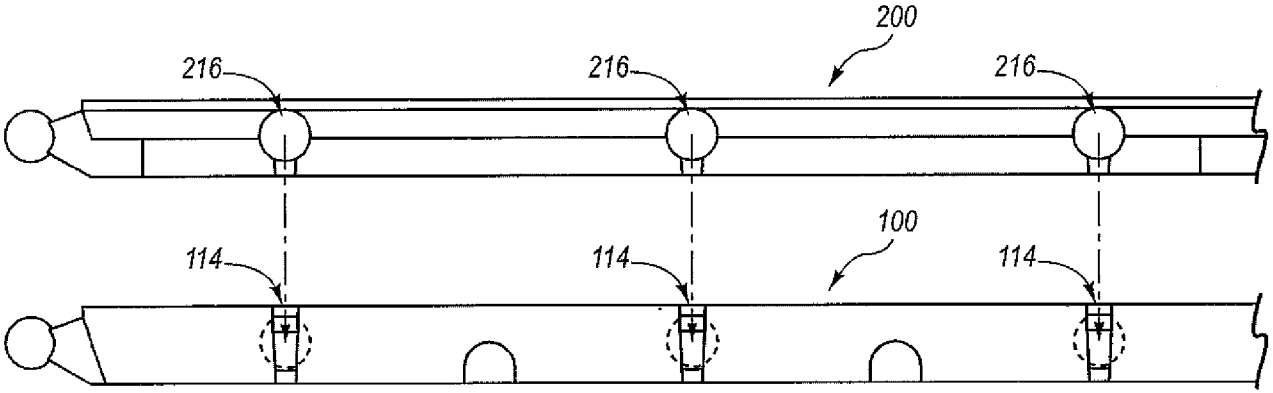
FIG. 11 is a side view of two of the modular floor tiles of FIG. 9 aligned prior to being interlocked.
Figure 12:
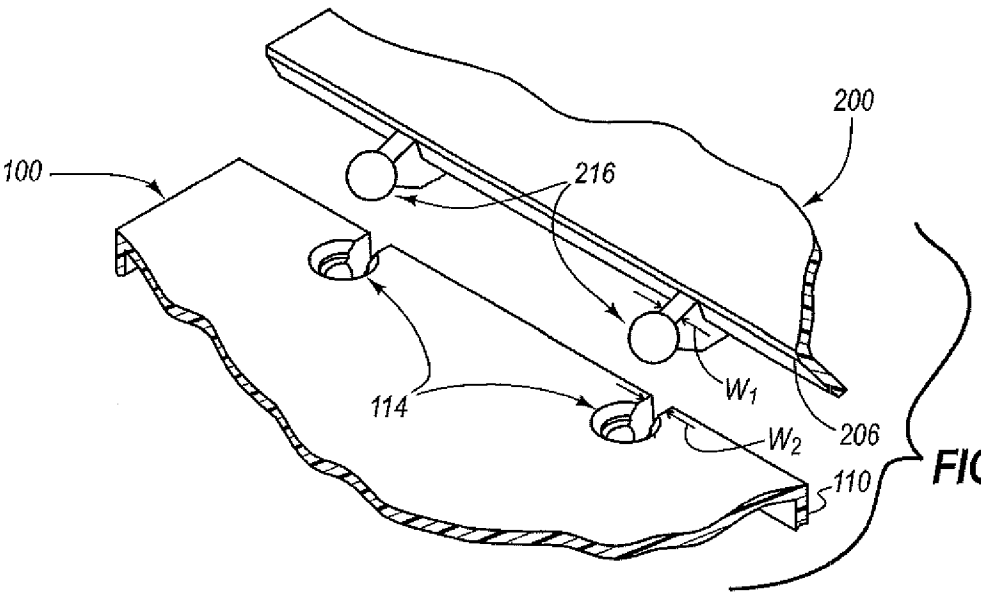
FIG. 12 is a top perspective view of a portion of the modular floor tiles of FIG. 11.
Figure 13:
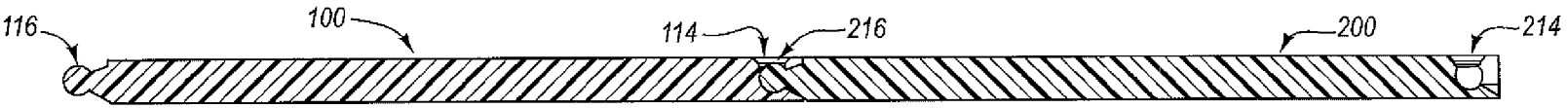
FIG. 13 is a cross-sectional view of the modular floor assembly of FIG. 9 taken along cross-sectional indicators 13-13.
Figure 19:
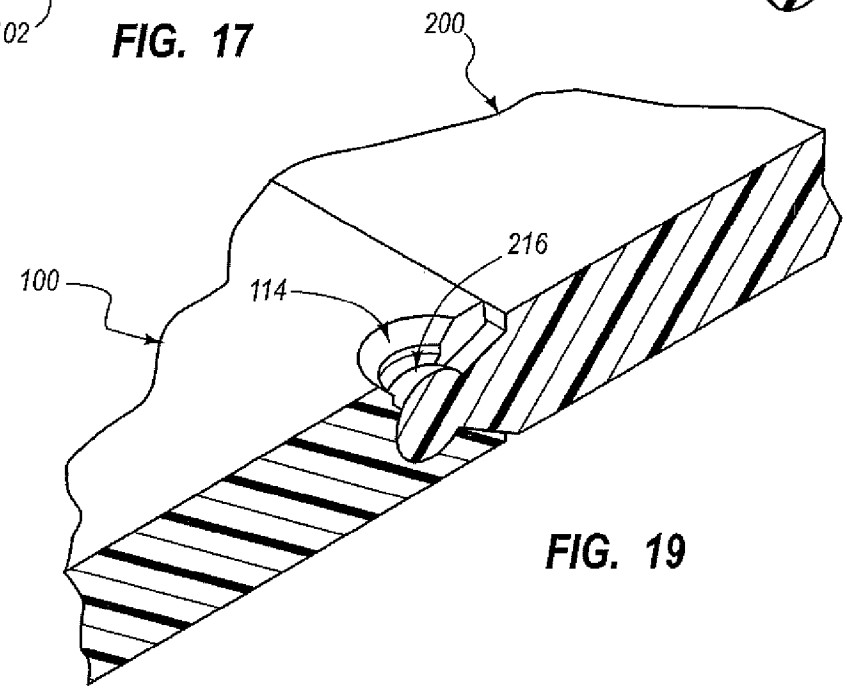
FIG. 19 is a perspective view of the assembly shown in FIG. 16.

Referring to FIGS. 11 and 12, an example assembly of adjacent modular floor tiles 100, 200 is shown. Assembly of the modular floor tiles 100, 200 is typically initiated by elevating one of the modular floor tiles relative to the adjacent modular floor tile (i.e., modular floor tile 200 being elevated relative to modular floor tile 100 in FIGS. 11 and 12) with the interlocking protrusions of one modular floor tile aligned with the interlocking recesses of the adjacent modular floor tile (i.e., interlocking protrusions 216 aligned with interlocking recesses 114). With the interlocking protrusions 216 aligned with the interlocking recesses 114, the modular floor tiles 100, 200 are moved vertically toward each other until the interlocking protrusions 216 extend into and interlock with the interlocking recesses 114. In some arrangements, only a portion of the interlocking protrusion 216 (i.e., the spherical portion 242) is first inserted into the interlocking recess 114, followed by pivotal movement of the modular floor tiles 100, 200 relative to each other until remaining portions of the interlocking protrusion 216 (i.e., the support portion 240) are inserted into other portions of the interlocking recess (i.e., the edge opening portion 122). The resulting interlocking connection between interlocking protrusion 216 and interlocking recess 114 is shown in further detail in FIGS. 13, 16 and 19. The modular floor tiles 100, 200 may be disconnected from each other by removing the interlocking protrusions 216 from the interlocking recesses 114 in an opposite vertical direction.

The interlocking recesses 114 and interlocking protrusions 216 may be constructed to provide a snap snap-fit connection between the modular floor tiles 100, 200. In at least one example, the snap-fit connection is releasable to provide disconnection between the interlocking recesses 114 and interlocking protrusions 216. In some arrangements, the snap-fit connection is permanent (i.e., damage to at least one of the modular floor tiles 100, 200 may occur as part of disconnecting the interlocking protrusions 216 from the interlocking recesses 114).

Other types of connections besides snap-fit connections are possible. For example, interference fit connections are possible. In one example, an interface between the interlocking protrusions 216 and the interlocking recesses 114 fixes a lateral position of the modular floor tiles 100, 200 relative to each other (i.e., at least one direction parallel with the top surfaces 104, 204) while permitting relative vertical motion between the modular floor tiles 100, 200 (i.e., in a direction perpendicular to the top surfaces 104, 204). The relative vertical motion may include a pivot motion provided by an interface between the interlocking protrusions 216 and interlocking recesses 114. When the modular floor assembly 10 is assembled and supported on a support surface such as a ground surface, the modular floor tiles 100, 200 may be fixed in at least one side-to-side direction relative to each other in at least, and may move vertically relative to each other (i.e., floor tile 200 moving vertically upward relative to the modular floor tile 100).

Figure 14:
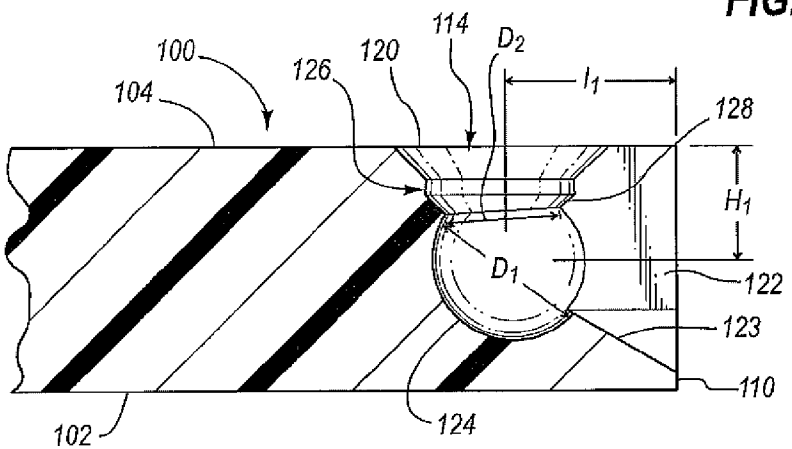
FIG. 14 is a close-up view of an interlocking recess of one of the modular floor tiles of FIG. 13.
Figure 15:
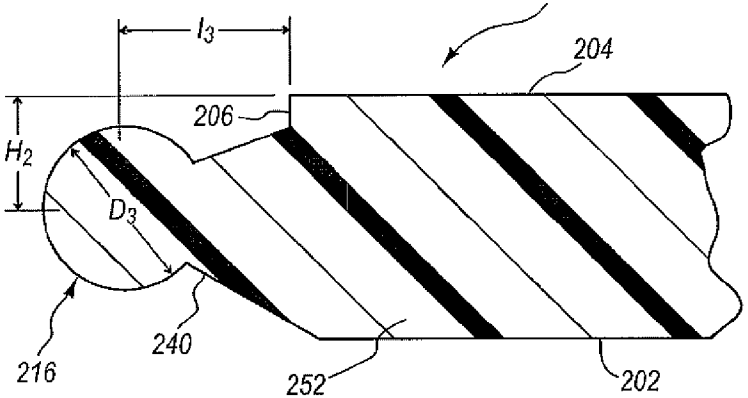
FIG. 15 is a close-up view of an example interlocking protrusion of one of the modular floor tiles of FIG. 13.
Figure 16:
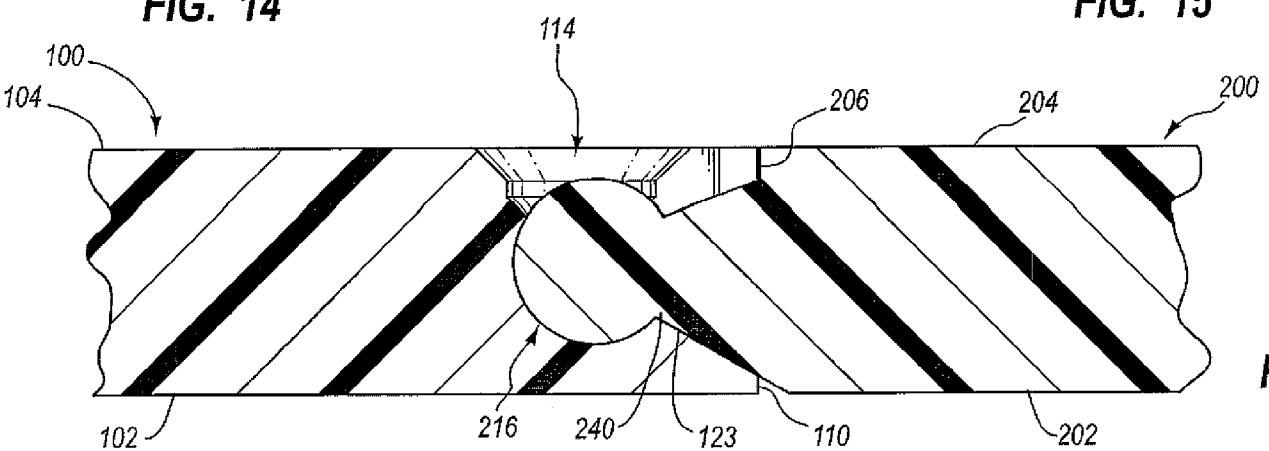
FIG. 16 is a close-up view of the interlocking protrusion of FIG. 15 positioned in the interlocking recess of FIG. 14.
Figure 18:
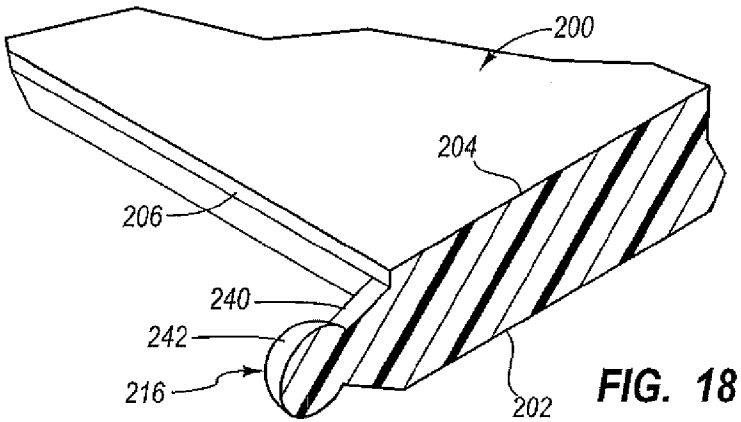
FIG. 18 is a close-up view of the interlocking protrusion of FIG. 15.
Figure 17:
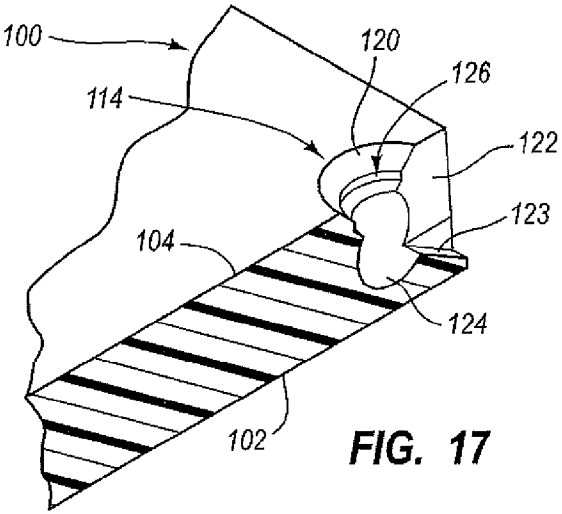
FIG. 17 is a perspective view of the interlocking recess shown in FIG. 14.

Referring now to FIGS. 14 and 15, further details related to the structure of the interlocking recesses 114, 216 are provided. The specific details discussed below related to the interlocking recesses 114 and interlocking protrusions 216 may be applied to the interlocking recesses and interlocking protrusions of any one or a combination of the modular floor tiles 100, 200, 300, 400 of the modular floor assembly 10.

Referring to FIG. 14, the interlocking recesses 114 include a top opening portion 120, an edge opening portion 122, a retention portion 124, and an entrance portion 126. The top opening portion 120 is positioned along the top surface 104. The edge opening portion 122 is positioned along the side edge 110. The edge opening portion 122 may be opened along both the top surface 104 and side edge surface 110.

The entrance portion 126 transitions between the top opening portion 120 and the retention portion 124. The top opening portion 120 may include a tapered surface that promotes insertion of the interlocking protrusion therein. The entrance portion 126 may also include a tapered surface 128 that transitions between a minimum opening size of the top opening portion 120 and a minimum size of the opening into the retention portion 124. The minimum opening size into the retention portion 124 has a dimension $D_2$. The dimension $D_2$ may be smaller than a maximum internal dimension $D_1$ of the retention portion 124.

The retention portion 124 may have a generally spherical shape or a spherical shaped portion. The retention portion 124 may have a curved or contoured portion, such as a curved pocket portion. The curved pocket portion may include a spherical portion. Many other shapes are possible for the retention portion 124 including, for example, oval, cubical, conical, triangular, and hexagonal. In at least some arrangements, the shape of the retention portion 124 substantially matches the shape of a portion of the interlocking protrusion. An interface between the matching portions of the retention portion 124 and the interlocking protrusion may provide a close fit between the retention portion 124 and the interlocking protrusion 216.

The top opening portion 120, retention portion 124 and entrance portion 126 may be open to and in communication with the edge opening portion 122. The size and shape of the edge opening portion 122 may substantially match a size and shape of a portion of the interlocking protrusion 216. In at least some arrangements, a portion of the interlocking protrusion 216 contacts a bottom surface 123 of the edge opening portion 122 while other portions of the interlocking protrusion are positioned in the retention portion 124 (see FIG. 16). The bottom surface 123 may provide a position stop for the interlocking protrusion within the interlocking recess that limits relative vertical rotation between adjacent tiles.

The retention portion 124 may be generally defined as a socket-shaped recess. The retention portion 124 may include at least a portion of a spherical shape. In at least one example, the retention portion 124 includes a hemispherical shaped portion. In other arrangements, the retention portion 124 may be defined as including a concave portion or a concave shape. In still further arrangements, the retention portion 124 may be defined as having a contoured portion or a curved portion such as a curved pocket portion. In still further arrangements, the retention portion 124 may be defined has having a pivot surface configured to mate with a pivot surface of the interlocking protrusion 216.

The retention portion 124 may be spaced inward a distance $I_1$ from the side edge 110. The retention portion 124 may also be recessed a depth $H_1$ from the top surface 104. The insert and depth distances $I_1$, $H_1$ may be measured relative to a central point of the retention portion 124. Alternatively, the inset and depth distances $I_1$, $H_1$ may be measured relative to any surface of the retention portion 124. Typically, retention portion 124 is completely spaced inward from the top surface 104 and side edge 110. However, other arrangements are possible in which the retention portion 124 is positioned adjacent to or in some cases, overlapping with, at least one of the top surface 104 and side edge 110.

The interlocking protrusion 216 includes a support portion 240 and a connection portion 242. The support portion 240 may have a width $W_1$ (see FIG. 12). The width $W_1$ may be substantially similar in size to a width $W_2$ of the edge opening portion 122 (see FIG. 12). In some arrangements, the width $W_1$ is less than the width $W_2$ to improve ease of aligning and inserting the interlocking protrusion 216 into the interlocking recess 114.

The support portion 240 may extend outward from the side edge 206. In at least some arrangements, the support portion 240 is aligned with one of the second supports 152. The support portion 240 may be continuous with one of the second supports 152 (see FIG. 2). In at least some arrangements, the support portion 240 may be formed integral with portions of the support structure 118, such as the second support 152 (see, for example, the structure of support member 252 in FIG. 15).

The connector portion 242 may have a maximum diameter or dimension $D_3$. The connection portion 242 may be positioned at an extension distance $I_3$ from the side edge 206. The connection portion 142 may also be subset a depth $H_1$ from the top surface 204. Typically, no part of the connection portion 242 is positioned vertically above the top surface 204 or laterally inward from the side edge 206. In other arrangements, at least portions of the connection portion 242 may be positioned inward of the side edge 206. In other arrangements, at least portions of the connection portion 242 may extend vertically above the top surface 204. In some arrangements, the connection portion 242 extending at least partially above the top surface 204 may define an additional structure along the top surface 204 that provides, for example, improved traction along the top surface 204.

The connection portion 242 may be constructed as a substantially spherical member. The connection portion 242 may include a curved or contoured portion. The curved portion of the connection portion 242 may include a spherical shape or a spherical shaped portion. The shape and size of the connection portion 242 may substantially match the shape and size of the retention portion 124 of the interlocking recess 114. in at least some arrangements, the maximum diameter $D_3$ of the connection portion 242 is smaller than the minimum dimension $D_2$ into the retention portion 124. Additional downward force may be needed to fit the connection portion 242 into the retention portion 124 when the dimension $D_2$ is smaller than the dimension $D_3$.

Once the connection portion 242 passes the entrance portion 126 into the retention portion 124, the connection portion 242 may be snap-fit into a locked position within the retention portion 124. The connection portion 242 and the portions of modular floor tile 100 that define the interlocking recess 114 may provide some elasticity or temporary deformation that permits easier insertion of the connection portion 242 into the retention portion 124.

The connection portion 242 may be defined as having a spherical or a semi-spherical shaped portion. The connection portion 242 may be defined as having a hemispherical portion or hemispherical shape. The connection portion 242 may also be defined as having a convex shaped portion. The connection portion 242 may be defined as having a contoured or curved portion or a contoured or curved surface. The connection portion 242 may define a pivot surface that is configured to mate with a pivot surface of the, retention portion 124 The connection portion 242 may be defined generally as a ball structure, which together with the "socket" structure defined by the retention portion 124 may provide a "ball-and-socket" connection arrangement between adjacent modular floor tiles.

The connection portion 242 may have other shapes such as, for example, oblong, cubical, conical, and other three-dimensional shapes. The connection portion 242, like the retention portion 124, may have various cross-sectional shapes such as, for example, oval, cubical, conical, triangular, and hexagonal. Typically, the shape of the connection portion 242 substantially matches the shape of the retention portion 124. In some arrangement, a portion of the connection portion 242 may substantially match the shape of a portion of the retention portion 124.

Interconnection between the socket-type construction of the retention portion 124 and the ball-type construction of the connection portion 242 may provide for some pivotal motion between the interlocking recess 114 and interlocking protrusion 216. In at least some arrangements, an interface between the support portion 240 of the interlocking protrusion 216 and the edge opening portion 122 of interlocking recess 114 limits side-to-side relative motion of the interlocking protrusion 216. The support portion 240 may be able to move vertically within the edge opening portion 122 to permit some pivotal motion between the connection portion 242 and the retention portion 124 in at least one vertical plane. In one example, a interface between a curved pocket portion (i.e., a portion of the retention portion 124) of the interlocking recess 114 and a curved interlocking portion (i.e., a portion of the connection portion 242) of the interlocking protrusion 216 allows adjacent tiles to pivot relative to each other.

Such pivotal movement may have certain advantages during use of the modular floor assembly 10. For example, when the modular floor assembly is in use, any relative pivotal movement permitted between adjacent modular floor tiles provided by the ball-and-socket type connection of the interlocking recesses and interlocking protrusions may provide some up-and-down movement along side edge surfaces of the modular floor tiles. This up-and-down movement may be sensed as "give" in the modular floor assembly for a user stepping on one or more of the interconnected modular floor tiles. Such "give" may provide additional shock absorption or other beneficial features for the user when a modular floor assembly is used as, for example, a sporting court surface.

The example modular floor tiles described herein may be made of any suitable polymer material known by those skilled in the art. The example modular floor tiles described herein may be made using any of a variety of manufacturing techniques such as, for example, injection molding.

While the example modular floor tiles shown in the example figures comprise a generally solid top surface with exception to the openings into the interlocking recesses, it may be possible to provide the modular floor tiles with a generally open type top surface such as, for example, the open top surface disclosed in U.S. Published Patent Application No. 2009/0031658, which is herein incorporated in its entirety by this reference. Further, the example modular floor tiles disclosed herein may comprise a support structure having multiple levels of support members such as described in U.S. Published Patent Application No. 2009/0031658. According to some aspects, the support system may comprise a multiple-tier suspension system, such as a two-tier suspension system having a plurality of support legs or protrusions extending down from a top surface of the modular floor tile. The ball-and-socket type interconnecting features disclosed herein with reference to the attached figures may be combined with any of the various shapes, sizes, and types of modular floor tiles available in the art.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

What is claimed is:

1. A method of forming a modular floor, comprising:

providing a first interlocking tile comprising at least one interlocking protrusion having a spherical shaped interlocking portion;

providing a second interlocking tile comprising at least one interlocking recess having a spherical shaped pocket portion and a recessed stop surface;

inserting the spherical shaped interlocking portion of the at least one interlocking protrusion of the first interlocking tile vertically into the spherical shaped pocket portion of the at least one interlocking recess of the second interlocking tile to connect the first interlocking tile to the second interlocking tile;

wherein an interface between the spherical shaped pocket portion and the spherical shaped interlocking portion allows the first and second interlocking tiles to pivot relative to each other, and wherein the recessed stop surface limits relative vertical rotation between the first and second interlocking tiles.

2. The method of claim 1, wherein the first interlocking tile includes a top surface and a plurality of edge surfaces, the at least one interlocking protrusion extending from one of the plurality of edge surfaces, and the second interlocking tile including a top surface and a plurality of side surfaces, the at least one interlocking recess being accessible at the top surface of the second interlocking tile, and inserting the at least one interlocking protrusion includes inserting the at least one interlocking protrusion into the at least one recess at the top surface.

3. The method of claim 2, wherein the at least one recess includes an edge portion defined in one of the plurality of edge surfaces of the second tile, and inserting the interlocking protrusion into the at least one recess including positioning a portion of the at least one interlocking protrusion into the edge portion of the at least one recess.

4. The method of claim 2, further comprising positioning the first and second tiles adjacent to each other with an edge surface of the first tile facing an edge surface of the second tile.

5. The method of claim 1, wherein prior to inserting the at least one interlocking protrusion in the at least one recess, positioning the at least one interlocking protrusion at a position elevated above the at least one recess.

6. The method of claim 1, wherein the first interlocking tile comprises a plurality of interlocking protrusions spaced apart along an edge of the first interlocking tile, and the second interlocking tile comprises a plurality of interlocking recesses spaced apart along a top surface of the second interlocking tile.

7. The method of claim 1, wherein the at least one interlocking recess comprises a circular shaped opening.

8. The method of claim 7, wherein the circular shaped opening is positioned on a top surface of the second interlocking tile.

9. A method of connecting a plurality of modular floor tiles, comprising:

providing a first modular floor tile comprising at least a first interlocking member;

providing a second modular floor tile comprising at least a second interlocking member;

inserting a spherical shaped first portion of the first interlocking member into a spherical shaped first portion of the second interlocking member while the first and second modular floor tiles are arranged in a first rotated position relative to each other;

pivoting the first and second modular floor tiles into a second rotated position relative to each other to insert a second portion of the first interlocking member into a second portion of the second interlocking member;

limiting relative rotation between the first and second modular floor tiles.

10. The method of claim 9, wherein the first portion of the first interlocking member includes a protrusion, and the first portion of the second interlocking member includes a recess having an open top portion, and inserting the first portion of the first interlocking member into the first portion of the second interlocking member includes inserting the protrusion through the open top portion of the recess and contacting the protrusion with the recess.

11. The method of claim 10, wherein an interface between the protrusion and the recess allows the first and second modular floor tiles to pivot relative to each other.

12. The method of claim 10, wherein pivoting the first and second modular floor tiles includes pivoting the first and second modular floor tiles relative to each other about an interface between the spherical shaped first portions of the first and second interlocking members.

13. The method of claim 9, wherein the first modular floor tile comprises a plurality of first interlocking members spaced apart along an edge of the first modular floor tile, and the second modular floor tile comprises a plurality of second interlocking members spaced apart along a top surface of the second modular floor tile.

14. The method of claim 9, further comprising inserting the first portion of the first interlocking member vertically into the first portion of the second interlocking member.

15. A method of forming a modular floor, comprising:

providing a first interlocking tile comprising a plurality of interlocking protrusions each having a spherical shaped interlocking portion;

providing a second interlocking tile comprising a plurality of interlocking recesses each having a spherical shaped pocket portion and a recessed stop surface, the spherical shaped pocket portion and the recess stop surface each being accessible on a top surface of the second interlocking tile;

inserting the spherical shaped interlocking portions of the plurality of interlocking protrusions into the spherical shaped pocket portions of the plurality of interlocking recesses to connect the first interlocking tile to the second interlocking tile; and pivoting the first and second interlocking tiles relative to each other after being connected until the recessed stop surface limits relative vertical rotation between the first and second interlocking tiles.

16. The method of claim 15, wherein the spherical shaped interlocking portions are inserted vertically into the spherical shaped pocket portions.

17. The method of claim 15, wherein the plurality of interlocking protrusions extend from an edge of the first interlocking tile.

18. The method of claim 17, wherein the spherical shaped interlocking portions are suspended from the edge by a support portion, the support portion extending through an edge surface of the second interlocking tile when the first and second interlocking tiles are connected.

19. The method of claim 15, wherein the spherical shaped pocket portion is accessible through a circular shaped opening on the top surface of the second interlocking tile.

* * * * *